United States Patent [19]

Price, Jr.

[11] Patent Number: 4,626,770

[45] Date of Patent: Dec. 2, 1986

[54] NPN BAND GAP VOLTAGE REFERENCE

[75] Inventor: John J. Price, Jr., Mesa, Ariz.

[73] Assignee: Motorola, Inc., Schaumburg, Ill.

[21] Appl. No.: 761,211

[22] Filed: Jul. 31, 1985

[51] Int. Cl.[4] ..... G05F 3/30

[52] U.S. Cl. ..... 323/313; 330/259

[58] Field of Search ..... 323/313, 314, 907; 330/259

[56] References Cited

U.S. PATENT DOCUMENTS

| | | | |
|---|---|---|---|
| 3,887,863 | 6/1975 | Brokaw | 323/314 |
| 4,087,758 | 5/1978 | Hareyama | 323/314 |
| 4,287,439 | 9/1981 | Leuschner | 323/314 |

FOREIGN PATENT DOCUMENTS

| | | | |
|---|---|---|---|
| 97619 | 7/1980 | Japan | 323/313 |

*Primary Examiner*—William H. Beha, Jr.

*Attorney, Agent, or Firm*—Michael D. Bingham

[57] ABSTRACT

A voltage reference circuit for providing a temperature compensated voltage at an output thereof comprise a pair of transistor operated at different current densities for producing a first and second voltages having complementary temperature coefficients and circuitry for combining the two voltages to produce the temperature compensated voltage. A pair of load resistors are connected to the collectors of the two transistors for sourcing currents thereto and a feedback circuit, including a differential amplifier coupled to the respective collectors, provides a feedback signal for adjusting the potential on the bases thereof to maintain different current densities in the two transistors. A bias circuit operates in conjunction with the differential amplifier to bias the same in a balanced operating state whenever the currents in the transistors are substantially equal.

12 Claims, 1 Drawing Figure

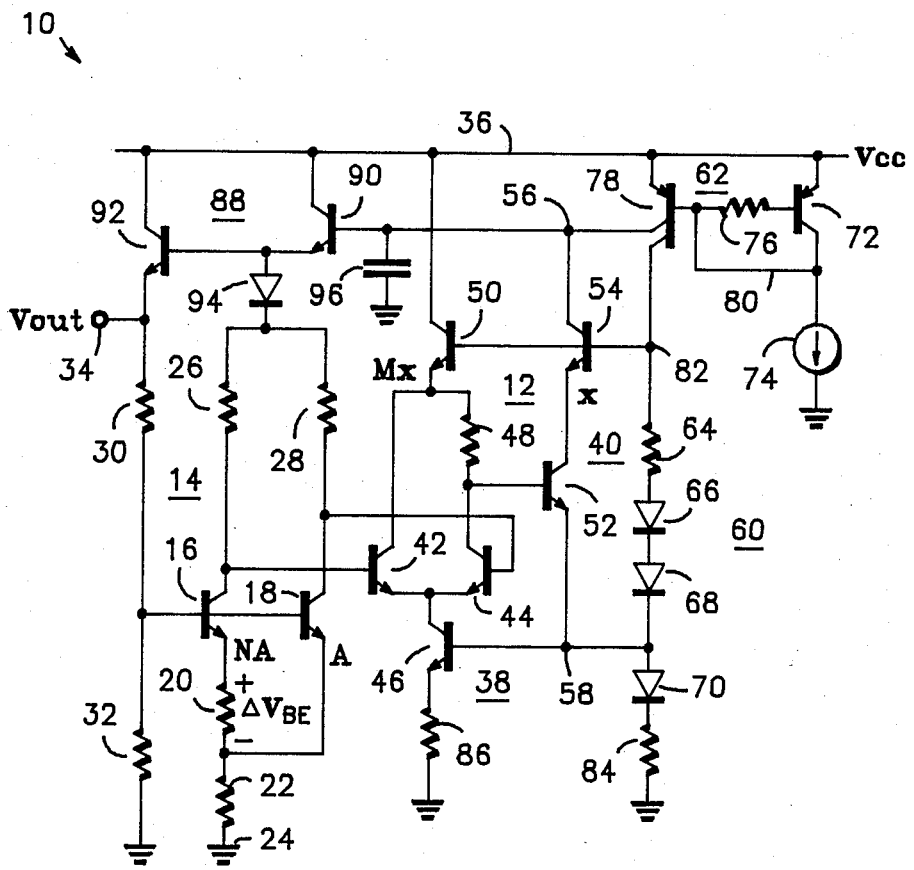
10
36
Vcc
88
90
56
78
62
92
76
72
94
96
50
54
80
Vout
34
26
Mx
12
x
82
74
30
28
48
40
64
14
66
52
60
16
42
18
68
44
NA
A
20
46
38
58
70
32
ΔVBE
86
84
22
24

NPN BAND GAP VOLTAGE REFERENCE

BACKGROUND OF THE INVENTION

The present invention relates to voltage regulators and, more particularly, to an integrated circuit (IC) bandgap voltage reference circuit.

Prior art bandgap voltage reference circuits, which are suitable to be produced in IC form, are well known. Typically, these circuits develop an output voltage having substantially zero temperature coefficient which is obtained by combining two potentials having complimentary temperature coefficients, i.e., one potential having a positive temperature coefficient while the other has a negative temperature coefficient.

In general, the two potentials are produced by using two transistors operated at different current densities as is well understood. By connecting a resistor in series with the emitter of the transistor that is operated at a smaller current density and then coupling the base of this transistor and the other end of the resistor across the base and emitter of the transistor operated at the higher current density produces a delta $V_{BE}$ voltage across the resistor that has a positive temperature coefficient. This positive temperature coefficient voltage is combined in series with the $V_{BE}$ of the second transistor which has a negative temperature coefficient in a manner to produce a composite voltage having a very low or zero temperature coefficient. These prior art voltage reference circuits are generally referred to as bandgap voltage references because the composite voltage is nearly equal to the bandgap voltage of silicon semiconductor material, i.e., approximately 1.2 volts.

Most good quality integrated bandgap voltage reference circuits of the type described above require high gain, high quality PNP transistors for sourcing currents to the first and second standard transistors bandgap cell. Typically, the two transistors of the bandgap cell are NPN devices with the first transistor having an emitter area that is ratioed with respect to the emitter area of the second transistor whereby the difference in the current density is established by maintaining the collector currents of the two transistors equal.

These prior art circuits are manufactured in integrated circuit form using contemporary high voltage semiconductor processes such that the required PNP transistors have excellent matched characteristics as well as high output impedances and high forward current gain. Such is not the case in most present day low voltage semiconductor processes. For example, in most, if not all, contemporary low voltage semiconductor processes, the PNP devices cannot be matched to tolerable tolerances and suffer both in their output impedance and forward current gain. Thus, the currents produced by PNP's formed using contemporary low voltage semiconductor processes cannot be matched nor maintained substantially the same from one process to the next or even from one circuit to the next using today's low voltage processes. Thus, practical low voltage bandgap reference circuits cannot be manufactured utilizing present day high speed, low voltage semiconductor processes because of the poor quality of the PNP current source transistors.

Hence, a need exists for a low voltage reference circuit for providing a bandgap reference voltage having excellent temperature performance, power supply rejection and load regulation that does not require well matched, high gain PNP transistors in the integrated circuit.

SUMMARY OF THE INVENTION

Accordingly, it is an object of the present invention to provide an improved voltage reference circuit.

It is another object of the present invention to provide an improved bandgap voltage reference circuit.

Still another object of the present invention is to provide an improved operational amplifier suitable to be used in a voltage reference circuit.

A further object of the invention is to provide an improved low voltage bandgap voltage reference circuit that does not require matched, high gain PNP transistors.

In accordance with the above and other objects there is provided a voltage reference circuit including first and second transistors operated at different current densities for developing first and second voltages having complimentary temperature coefficients and means for combining the two voltages to produce a regulated output voltage and feedback circuitry for adjusting the base potential of the two transistors to maintain the transistors operating at the different current densities wherein the improvement resides in the feedback circuitry including a differential amplifier input stage having inputs coupled respectively to the collectors of the first and second transistors and an output, an output gain stage coupled between the output of differential amplifier input stage and the bases of the first and second transistors respectively and a bias circuit for biasing the two gain stages in a quiescent balanced operating state.

BRIEF DESCRIPTION OF THE DRAWING

The sole FIGURE is a schematic diagram illustrating the voltage reference circuit of the preferred embodiment of the invention.

DETAILED DESCRIPTION OF THE PREFERRED EMBODIMENT

Turning to the sole FIGURE, NPN bandgap voltage reference circuit 10 is illustrated as comprising operational amplifier 12 and bandgap cell 14. Bandgap cell 14 is generally known in the art and includes first and second transistors 16 and 18 the emitters of which are coupled together through resistor 20. The emitter of transistor 18 is connected through series resistor 22 to power supply conductor 24 at which is applied a ground reference potential. The collectors of transistors 16 and 18 are coupled respectively through load resistors 26 and 28 to a source of direct current operating potential. However, in most, if not all, prior art bandgap cells realized in integrated circuit form the collectors of transistors 16 and 18 are connected in series with respective high gain PNP transistors which source current to the collectors and not through only load resistors 26 and 28. The bases of transistor 16 and 18 are connected together such that the base to emitter of transistor 18 is in parallel with the base emitter of transistor 16 and series connected resistor 20.

In operation, the currents sourced through load resistors 26 and 28 to the collectors of transistors 16 and 18 are set equal to one another such that the two transistors are operated at difference current densities due to the fact that transistor 16 has a emitter area which is ratioed with respect to the emitter area of transistor 18, i.e., the emitter area of transistor 16 is N times the emitter area A of transistor 18 (where N is any positive number). Since transistor 16 has a larger emitter area it is operated at a lower current density than transistor 18 such that a voltage, $\Delta V_{BE}$ is produced across resistor 20 that has a positive temperature coefficient. The voltage between the base and emitter of transistor 18 has a negative temperature coefficient. The positive temperature coefficient voltage developed across resistor 20 produces a current therethrough that has a positive temperature coefficient and which flows through resistor 22. Hence, a voltage is developed across resistor 22 which also has a positive temperature coefficient that then is combined with the negative temperature coefficient $V_{BE}$ voltage developed across the base to the emitter of transistor 18. A composite voltage is then produced at the bases of the two transistors that has a substantially zero temperature coefficient. This regulated voltage is nearly equal to the bandgap voltage of the silicon semiconductor material used to form transistor 16 and 18. By ratioing resistors 20 and 22, as well as, resistors 30 and 32 (which are interconnected in series at the bases of transistor 16 and 18) a voltage $V_{OUT}$ and is developed at output terminal 34 that can be made proportional to the aforementioned bandgap potential. For example, by ratioing resistors 30 and 32 the voltage at the bases of the transistor 16 and 18 can be multiplied to give an output voltage of approximately 2.5 volts with a direct current, dc, operating potential $V_{CC}$ of 5 volts supplied to the power supply conductor 36.

In prior art bandgap voltage reference circuits the aforedescribed bandgap cell 14 is utilized in conjunction with a feedback circuit connected between the collectors of transistors 16 and 18 and output 34 to adjust the base potentials thereof in order to maintain the different current densities in the two transistors. For example, these prior art voltage reference circuits, as aforementioned, require a PNP transistor current mirror circuit to source collector currents to the respective collectors of transistors 16 and 18. In nominal operation the collector currents of transistors 16 and 18 are maintained equal whereby the two transistors are operated at different current densities. If for any reason the two collector currents are not equal a difference in the voltage at the collectors will be established which is sensed by the feedback circuit. The feedback circuit produces a feedback signal to drive the base potential of the two transistors 16 and 18 accordingly until such time that the collector currents are equalized. A typical prior art voltage reference circuit of the type described above is the MC1503 voltage reference circuit manufactured by Motorola, Inc.

A problem with the above described prior art circuit arises due to the fact that the circuit requires high quality, high gain, high impedance PNP transistors. Such devices can be fabricated using contemporary high voltage integrated circuit processes. However, for many reasons high voltage processes may not be available or may not be suitable for the application requiring such a voltage reference circuit. For instance, there is a need for a voltage reference circuit using a low voltage integrated circuit process. Such processes are available, however, high performance PNP transistors cannot be realized using this low voltage process. Typical PNP devices fabricating using present day low voltage semiconductor processes do not exhibit high current gain and high output impedances. Thus, a bandgap reference having excellent temperature performance, supply rejection and load regulations cannot be manufactured utilizing contemporary low voltage semiconductor processes if such circuits require high gain PNP transistors.

The present invention eliminates the need for high gain PNP transistors in the critical circuit portions of bandgap cell 14 and allows an NPN voltage reference circuit to be manufactured in integrated circuit form using present day low voltage semiconductor processes.

Referring to the FIGURE, resistors 26 and 28 form the resistor loads to bandgap cell 14 which are connected to the differential inputs of high gain operational amplifier 12. Operational amplifier 12 is comprised of differential amplifier input gain stage 38 and output gain stage 40. Transistors 42 and 44 are connected as a differential pair with their emitters coupled to current sink transistor 46 in a conventional manner. A single ended output is taken at the collector of transistor 44 across load resistor 48 that is coupled between the collectors of the aforementioned transistors to the emitter of transistor 50. The bases of transistor 42 and 44 are respectively coupled to the collectors of transistors 16 and 18 of bandgap cell 14. The loss of gain due to not using PNP transistors in bandgap cell 14 is compensated for by high gain operational amplifier section 12.

Output gain stage 40 includes interconnected transistors 52 and 54. The input of output gain stage 40 is coupled to the output of input gain stage 38 at the base of transistor 52. The collector-emitter current path of transistor 52 is coupled between the emitter of transistor 54 and circuit node 58 with the collector of transistor 54 being coupled to node 56. A bias current circuit 60 for providing quiescent bias for the two gain stages of operational amplifier 12 comprises current mirror 62, resistor 64 and series connected semiconductors diode 66, 68 and 70. Current mirror 62 includes PNP transistor 72, the emitter of which is coupled to power supply conductor 36 with its collector to thermal current source 74. The base of transistor 72 is coupled via resistor 76 to the base of transistor 78 and, through lead 82, to its collector. As is understood, the current flowing through transistor 72 is mirrored by multiple collector transistor 78, the emitter of which is coupled to power supply 36, to produce first and second equal currents at respective outputs to node 56 and 82. Current mirror or current source 62 is not required to be accurately set, it only requires that the two collectors of transistor 78 are matched to supply substantially equal currents.

Assuming the voltages at the bases of transistors 42 and 44 of differential amplifier input gate stage 38 are equal and stable, bias circuit 60 will bias the two gain stages of operational amplifier 12 to a balanced operating state when the voltage developed between nodes 82 and 58, across resistor 64, and diode 66 and 68 equals the voltage developed between the same two nodes across transistor 52, resistor 48 and the base to emitter of transistor 50. In this state, a current is sourced through transistor 50, which has its collector coupled to power supply conductor 36, that is equal to twice the current flow through transistors 54 and 52 due to the fact that, as indicated, the emitter area of transistor 50 is ratioed with respect to transistor 54. Thus, the currents flowing through transistors 42 and 44 will be equal to each other and will be equal to the current flowing through resistor 64 and diodes 66 and 68. The current flowing from the emitter of transistor 52 combines with the current flowing through diode 68 to flow through diode 70 and resistor 84. This current is mirrored by transistor 46 and is equal to the current sourced through transistors 42 and 44 to the collector thereof.

Hence, at a stable bias condition, a feedback signal is produced through buffer circuit 88 comprising emitter follower configured transistors 90 and 92 to produce a voltage across resistor 32 which drives the bases of transistor 16 and 18. This feedback signal in turn establishes the regulated output voltage $V_{OUT}$.

By matching devices 50 and 52 with diodes 66 and 68 and making resistors 48 and 64 equal value and of the same semiconductor material, the voltage drop across each leg, as described above, will be equal. Base current errors and base width modulation effects are compensated in the two legs so that offset errors are very small.

In operation, if for some reason there is a current difference between transistors 16 and 18, operational amplifier operates as a comparator to sense a voltage change at the collectors of the two transistors to produce a feedback signal via emitter follower transistors 90 and 92. This feedback signal changes the potential appearing at the bases of transistor 16 and 18 accordingly. As a result, the currents through transistors 16 and 18 are adjusted to be equal. A buffered operating voltage is supplied via diode 94 to resistors 26 and 28. Capacitor 96 acts as a compensation capacitor to inhibit oscillation of the high gain stage as is understood.

Thus, what has been described above, is a novel bandgap voltage reference circuit combining a bandgap cell and feedback circuitry which includes a novel operational amplifier. The bandgap cell utilizes first and second transistors operating at different current densities to produce a regulated output voltage that is temperature compensated. The operational amplifier senses a voltage difference appearing at the collectors of the two transistors of the bandgap cell to develop a feedback signal for adjusting the base potential of the two transistors to maintain the different current densities therethrough. The high gain operational amplifier permits resistive loads to be used in the bandgap cell which eliminates the requirement for matched, high gain PNP transistors therein.

I claim:

1. A voltage reference circuit including circuit means comprising first and second transistors operated at different current densities for developing first and second voltages having complementary temperature coefficients, means for sourcing currents to the transistors, means for combining the first and second voltages to establish a temperature compensated voltage at an output and feedback circuitry responsive to the voltages appearing at the collectors of the first and second transistors for adjusting the potential at the bases thereof to maintain the transistors operating at different current densities, the improvement comprising the feedback circuitry including:

current source means for providing first and second substantially equal currents at first and second outputs;

amplifier means including a differential amplifier input stage, said amplifier means having an output and first and second inputs coupled respectively to the collectors of the first and second transistors, said amplifier means acting as a current sink for said first current and being responsive to the voltages appearing at the collectors of the first and second transistors for providing a feedback signal at said output thereof that is used to adjust the base potential of the first and second transistors; and bias circuit means receiving said second current at said second output of said current source means and being coupled with said amplifier means and which operates in conjunction therewith for biasing said amplifier means at a quiescent balanced operating condition wherein the currents through the first and second transistors tend to be made equal to one another.

2. The voltage reference circuit of claim 1 including:

first and second power supply conductors at which are supplied an operating and ground reference potential respectively; and said bias circuit means comprising a first resistor coupled to said second output of said current source means at a first circuit, node, first and second semiconductor diode means serially coupled between said first resistor and a second circuit node, and third semiconductor diode means coupled between said second circuit node and said second power supply conductor.

3. The voltage reference circuit of claim 2 wherein said amplifier means includes:

said differential amplifier input stage having a pair of inputs corresponding to said first and second inputs respectively and an output; and an output amplifier stage coupled between said output of said differential amplifier stage and the output of the circuit whereby said differential amplifier stage and said output amplifier stage comprise a high gain comparator amplifier responsive to the difference in the collector voltages of the first and second transistors to provide the feedback signal.

4. The voltage reference circuit of claim 3 wherein said output amplifier stage includes:

a third transistor having first and second main electrodes and a control electrode said control electrode being coupled to said first circuit node, said second main electrode being coupled to said first output of said current source means at which is provided said first current; and a fourth transistor having first and second main electrodes and a control electrode, said second main electrode being connected to said first main electrode of said third transistor, said first main electrode being coupled to said second circuit node, and said control electrode being coupled to said output of said differential amplifier input stage.

5. The voltage reference circuit of claim 3 wherein said differential amplifier input stage includes:

third and fourth transistors each having first and second main electrodes and control electrodes, said first main electrodes being connected together, said control electrodes being said first and second inputs respectively;

a second resistor coupled between said second main electrodes of said third and fourth transistors with said second main electrode of said fourth transistor being coupled to said output of said differential amplifier input stage, said second resistor being of substantially same value and having a temperature coefficient that is substantially the same as said first resistor;

a fifth transistor having first and second main electrodes and a control electrode, said control electrode being coupled to said first circuit node, said first main electrode being coupled to the interconnection between said first resistor and said second main electrode of said third transistor, said second main electrode being coupled to said first power supply conductor; and a sixth transistor having first and second main electrodes and a control electrode, said second and first main electrodes being coupled respectively to said interconnected first main electrodes of said third and fourth transistors and said second power supply conductor, said control electrode being coupled to said second circuit node whereby said sixth transistor sinks a current therethrough which is substantially equal to the current sourced through said third semiconductor diode means.

6. The voltage reference circuit of claim 5 wherein said output amplifier stage includes seventh and eighth transistors each having first and second main electrodes interconnected so that said seventh and eighth transistors are connected between said second output of said current source means and said second current node, said seventh and eighth transistors each having a control electrode with said control electrode of said seventh transistor being coupled to said first circuit node and said control electrode of said eighth transistor being coupled to said output of said differential amplifier stage.

7. An integrated voltage reference circuit including circuit means for developing a voltage reference circuit including circuit means comprising first and second transistor operated at different current densities for developing first and second voltage having complementary temperature coefficients, means for sourcing currents to the transistors, means for combining the first and second voltages to establish a temperature compensated voltage at an output and feedback circuitry responsive to the voltages appearing at the collectors of the first and second transistors for adjusting the potential at the bases thereof to maintain the transistors operating at different current densities, the improvement comprising the feedback circuitry including:

current source means for providing first and second substantially equal currents at first and second outputs;

amplifier means including a differential amplifier input stage, said amplifier means having an output and first and second inputs coupled respectively to the collectors of the first and second transistors, said amplifier means acting as a current sink for said first current and being responsive to the voltages appearing at the collectors of the first and second transistors for providing a feedback signal at said output thereof that is used to adjust the base potential of the first and second transistors; and bias circuit means receiving said second current and being coupled with said amplifier means and which operates in conjunction therewith for biasing said amplifier means at a quiescent balanced operating condition wherein the currents through the first and second transistors tend to be made equal to one another.

8. The voltage reference circuit of claim 7 including:

first and second power supply conductors at which are supplied an operating and ground reference potential respectively; and said bias circuit means comprising a first resistor coupled to said first output of said current source means at a first circuit node, first and second semiconductor diode means serially coupled between said first resistor and a second circuit node, and third semiconductor diode means coupled between said second circuit node and said second power supply conductor.

9. The voltage reference circuit of claim 8 wherein said amplifier means includes:

said differential amplifier input stage having a pair of inputs corresponding to said first and second inputs respectively and an output; and an output amplifier stage coupled between said output of said differential amplifier stage and the output of the circuit whereby said differential amplifier stage and said output amplifier stage comprise a high gain comparator amplifier responsive to the difference in the collector voltages of the first and second transistors to provide the feedback signal.

10. The voltage reference circuit of claim 9 wherein said output amplifier stage includes:

a third transistor having first and second main electrodes and a control electrode, said control electrode being coupled to said first circuit node, said second main electrode being coupled to said first output of said current source means at which is provided said first current; and a fourth transistor having first and second main electrodes and a control electrode, said second main electrode being connected to said first main electrode of said third transistor, said first main electrode being coupled to said second circuit node, and said control electrode being coupled to said output of said differential amplifier input stage.

11. The voltage reference circuit of claim 9 wherein said differential amplifier input stage includes:

third and fourth transistors each having first and second main electrodes and control electrodes, said first main electrode being connected together, said control electrodes being said first and second inputs;

a second resistor coupled between said second main electrodes of said third and fourth transistors with said second main electrode of said fourth transistor being coupled to said output of said differential amplifier input stage, said second resistor being of substantially same value and having a temperature coefficient that is substantially the same as said first resistor;

a fifth transistor having first and second main electrodes and a control electrode, said control electrode being coupled to said first circuit node, said first electrode being coupled to the interconnection between said first resistor and said second main electrode of said third transistor, said second main electrode being coupled to said first power supply conductor; and a sixth transistor having first and second main electrodes and a control electrode, said second and first main electrodes being coupled respectively to said interconnected first main electrodes of said third and fourth transistors and said second power supply conductor, said control electrode being coupled to said second circuit node whereby said sixth transistor sinks a current therethrough which is substantially equal to the current sourced through said third semiconductor diode means.

12. The voltage reference circuit of claim 11 wherein said output amplifier stage includes seventh and eighth transistors each having first and second main electrodes interconnected so that said seventh and eighth transistors are connected between said second output of said current source means and said second current node, said seventh and eighth transistors each having a control electrode with said control electrode of said seventh transistor being coupled to said first circuit node and said control electrode of said eighth transistor being coupled to said output of said differential amplifier stage.

* * * * *